US007052360B2

(12) United States Patent
Lau

(10) Patent No.: US 7,052,360 B2
(45) Date of Patent: May 30, 2006

(54) BRASSIERE AND RELATED BREAST CUP CONSTRUCTION

(75) Inventor: Bull Lau, Shenzhen (HK)

(73) Assignee: Victoria's Secret Stores Brand Management, Inc., Reynoldsburg, OH (US)

( * ) Notice: Subject to any disclaimer, the term of this patent is extended or adjusted under 35 U.S.C. 154(b) by 0 days.

(21) Appl. No.: 10/804,403

(22) Filed: Mar. 19, 2004

(65) Prior Publication Data

US 2005/0208874 A1 Sep. 22, 2005

(51) Int. Cl.
*A41C 3/00* (2006.01)

(52) U.S. Cl. ..... 450/57; 450/54; 2/267

(58) Field of Classification Search ..... 450/39, 450/1, 54–57, 90, 929.3; 2/267, 268, 243.1, 2/697.3, 78.1–78.4; 264/257, 258, 291, 292, 264/294, 320, 321, 145, 152–155, 157–160, 264/163; 156/245

See application file for complete search history.

(56) References Cited

U.S. PATENT DOCUMENTS 2,727,278 A * 12/1955 Thompson ..... 264/46.4
3,464,418 A * 9/1969 Silverman ..... 450/57
3,597,800 A * 8/1971 Silverman ..... 425/290
3,891,378 A * 6/1975 Belmuth et al. ..... 425/398
4,025,597 A * 5/1977 Sawamoto ..... 264/138
4,080,416 A * 3/1978 Howard ..... 264/258
4,244,249 A * 1/1981 DiTullio ..... 83/139
4,701,230 A * 10/1987 Loi ..... 156/145
5,340,352 A * 8/1994 Nakanishi et al. ..... 450/57
6,036,577 A * 3/2000 Coburn ..... 450/57
6,042,608 A * 3/2000 Ishikawa et al. ..... 623/7
6,811,464 B1 * 11/2004 Li ..... 450/57

* cited by examiner

*Primary Examiner*—Gloria M. Hale
(74) *Attorney, Agent, or Firm*—Colucci & Umans; Angelo Notaro; Peter C. Michalos

(57) ABSTRACT

A molded breast cup for a brassiere includes a molded cup form and laminated structure of a first panel of a flexible foam material and a second panel of flexible material. The first and second panels are substantially coextensive to each other and define a breast cup perimeter shape. The first panel of flexible foam material is of varying thickness, providing a zone of greater thickness at a region or regions away from the perimeter at a general area where the nipple of the wearer of the brassiere will normally be positioned in order to provide greater thickness of material or density of material at such regions to reduce the visibility of the nipple through the brassiere.

25 Claims, 4 Drawing Sheets

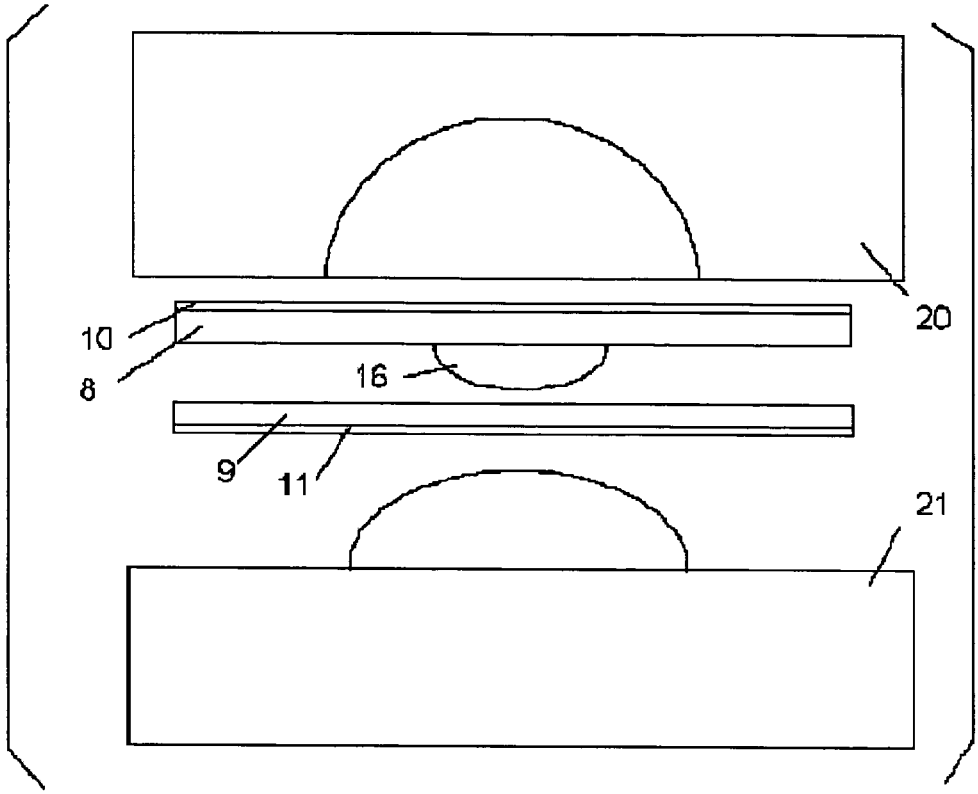
FIG. 3
FIG. 4
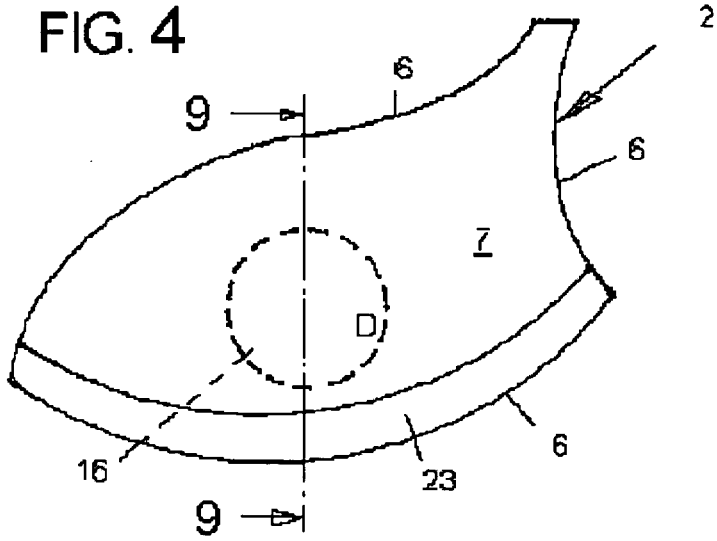

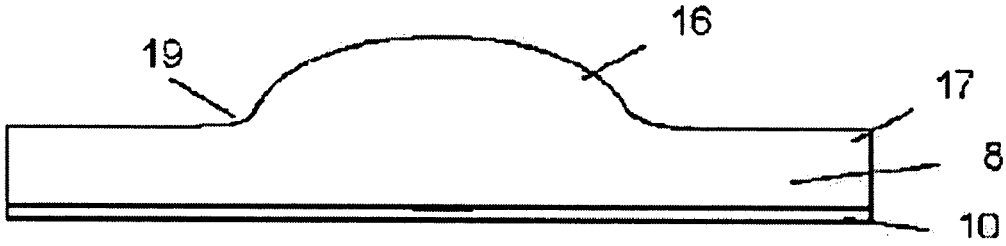
FIG. 5
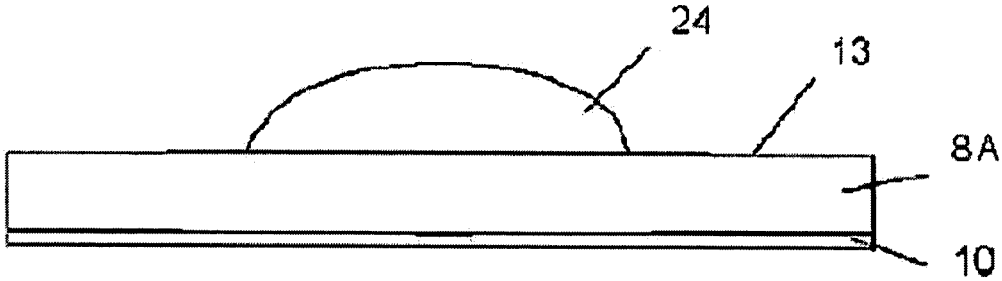
FIG. 6
FIG. 7
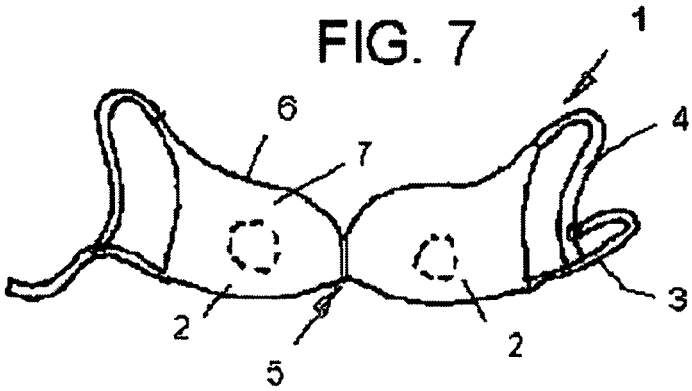

BRASSIERE AND RELATED BREAST CUP CONSTRUCTION

FIELD OF THE INVENTION

The present invention relates to a brassiere and also to a breast cup construction for incorporation to form a brassiere the breast cup construction being of a molded kind.

BACKGROUND OF THE INVENTION

In recent times, materials for the manufacture of brassieres have been developed to allow for more convenient manufacture of brasserie. Traditionally the cup forms of a brassiere have in order to introduce a three dimensional cup shape therein, consisted of several panels which have been sewn or otherwise affixed together. With the advent of moldable synthetic materials such as foam and synthetic fabric materials, cup forms are now molded into a single panel of material or assembly of panels of materials to define the three dimensional cup form. The ability to mold material to define a cup form of a desirable shape has allowed the manufacturing process to be simplified or accelerated. As well as providing support to a breast of a wearer, the cup forms are often also required for additional benefits to the wearer. Indeed some women prefer that a brassiere conceals some if not all of the regions of the breasts of the wearer. Indeed for modesty reasons it is desirable that the nipples of a wearer at all times remain unnoticeable from the exterior of the brassiere and any over garment that may be worn by the wearer. Molded cup forms of brassieres that are currently available generally do not provide for any enhancement to the cup form for such purposes. Molded cup forms are normally of a substantially even thickness across the body of the cup and whilst it may be possible to increase the thickness of the cup in order to thereby reduce the visibility of the nipples of a wearer to the exterior of the brassiere such increasing thickness may add to the cost of manufacture of the brassiere. Furthermore it is undesirable for increased thickness of the brassiere to exist at its perimeter if the presence of the brassier entirely, is to be as unobtrusive as possible. It is desirable for the perimeter of the bra to be relatively thin so that it has the appearance of feathering in with the skin of the wearer.

Accordingly it is an object of the present invention to provide a brassiere which includes molded cup forms which address the abovementioned desire or which will at least provide the public with a useful choice.

It is a further object of the present invention to provide a moulded cup form for incorporation into a brassiere which addresses the abovementioned desiderata or which will at least provide the public with a useful choice.

BRIEF DESCRIPTION OF THE INVENTION

Accordingly in a first aspect of the present invention consists in a molded breast cup for a brassiere including

- a molded to a cup form and laminated structure of a first panel of a flexible foam material and a second panel material, said first and second panels being substantially coextensive to each other and define a breast cup perimeter shape,
- wherein said first panel of flexible foam material is of varying thickness, providing a zone of greater thickness at a region or regions away from said perimeter more than regions of lesser thickness more proximate to said perimeter.

Preferably said second panel is a flexible foam material.

Preferably said second panel is a flexible fabric material.

Preferably said zone of greater thickness is located at where, in use, a nipple of the wearer of said brassiere incorporating said breast cup is normally located.

Preferably said first panel is of a uniform thickness save for at said zone of greater thickness.

Preferably said first panel is of a uniform thickness save for at said zone of greater thickness, the zone of greater thickness having a maximum thickness at the center of said zone and being of a gradually reducing thickness towards the perimeter of the zone.

Preferably the transition of thickness between said zone of greater thickness and said uniform thickness region of said first panel of flexible foam material is without sudden thickness change.

Preferably said transition of thickness between said zone of greater thickness and said uniform thickness region of said first panel of flexible foam material is with of a smooth transition.

Preferably said first panel has said varying thickness introduced by a contouring (in addition to contouring consequent of said cup form) of a first major side thereof, the second major side thereof being uncontoured other than having been formed to said cup shape.

Preferably said first major side of said first panel is disposed to the second panel.

Preferably said first major side of said first panel is engaged to the second panel.

Preferably said first panel is engaged to the second panel.

Preferably said first panel is a unitary panel.

Preferably said first panel consists of a first ply of foam material of a uniform thickness and a second ply of material engaged therewith in a manner to create said zone of greater thickness.

Preferably said second ply is of a foam material.

Preferably a first panel of fabric material overlies said assembly to the concave said of its said cup shape.

Preferably said first panel of fabric material is laminated to one of said first panel of flexible foam material and second panel.

Preferably a first panel of fabric material overlies said assembly to the concave side of its said cup shape.

Preferably said second panel of fabric material is laminated to the other of said first flexible foam material and said second panel.

Preferably said first panel is disposed to the concave side of said cup shape and said second panel is disposed to the convex side of said cup shape.

Preferably wherein a second panel of fabric material overlies said assembly to the convex of side of its said cup shape.

Preferably said first panel is disposed to the concave side of said cup shape and said second panel is disposed to the convex side of said cup shape.

Preferably said first and second panels contain no seams, lines of stitching inward of a region immediately adjacent said perimeter.

In a further aspect the present invention consists in a molded breast cup as hereinbefore described containing no seams, lines of stitching inward of a region immediately adjacent said perimeter.

In a further aspect the present invention includes a brassiere incorporating a breast cup as hereinbefore described.

In a further aspect the present invention consists in a method of forming a molded breast cup comprising laminating (a) a first planar panel of a flexible foam material which is of varying thickness such having been defined by a removal to form a contouring material from a first major surface of said first planar panel to create a zone which is of greater thickness at a region or regions away from the perimeter more, that at regions of lesser thickness more proximate to said perimeter, with (b) a second panel of flexible material wherein said second panel is disposed to the first major side of the said panel, to form a coextensive planar assembly molding said planar assembly to define a cup shape into said planar assembly removing any access non cup shape defined regions from said assembly.

In still a further aspect the present invention consists in a method of forming a molded breast cup comprising laminating (a) a first planar panel of a first ply of flexible foam material and a second ply of flexible foam material engaged to a first major sided of said first ply said first panel is of varying thickness such having been defined the provisions of said second ply to said first ply to create a zone which is of greater thickness at a region or regions away from the perimeter more, that at regions of lesser thickness more proximate to said perimeter, with (b) a second panel of flexible material wherein said second panel is disposed to the first major side of the said panel, to form a coextensive planar assembly molding said planar assembly to define a cup shape into said planar assembly removing any access non cup shape defined regions from said assembly.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth. For the purposes of illustrating the invention, there is shown in the drawings a form which is presently preferred. It is being understood however that this invention is not limited to the precise arrangements shown.

BRIEF DESCRIPTION OF THE DRAWINGS

A preferred form of the present invention will now be described with reference to the accompanying drawings in which FIG. 3, illustrates two sets of panel assemblies prior to such sets being laminated together and prior to being formed into a three dimensional cup form by the molding elements intermediate of which the two assemblies are located.

FIG. 4, is a plan view of a cup form having been molded and trimmed to define a perimeter suitable for incorporation as part of a brassiere, FIG. 5 is a sectional view through an alternative configuration of an assembly of panels to that of FIG. 2, FIG. 6 is an alternative to FIG. 5, FIG. 7 is a perspective view of a brassiere incorporating the cup forms.

DETAILED DESCRIPTION OF THE INVENTION

Figure 1A:
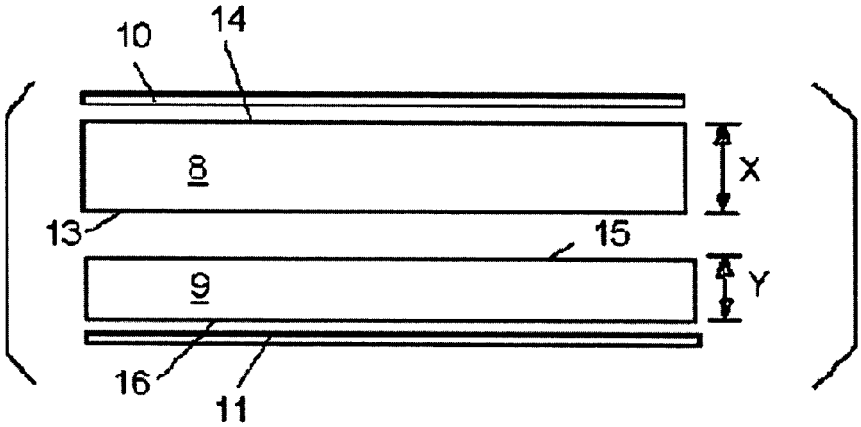
FIG. 1A is an exploded sectional view through the assembly of panels prior to being formed and laminated together for the purposes of providing the cup of the present invention.

With reference to FIG. 7 there is shown a brassiere 1 including two breast cup constructions 2 which have been engaged to various other components of the brassiere 1 such as for example body straps 3 and over the shoulder straps 4. The breast cups 2 are engaged together at an intermediate connection 5. The breast cups have a perimeter 6 and a body portion 7 inward of the perimeter 6. The breast cup is of a form having been molded and to a large extent is of a single structure consisting of a plurality of overlying and preferably substantially coextensive panels defining the assembly of the cup form. It is however envisaged that the breast cup of the present invention may have disposed therefrom or engaged thereto by means of sewing or otherwise affixing additional panels which may extend from the perimeter 6 of the cup form or may be associated with the cup form 2 intermediate of the perimeter 6 and define part of the body portion 7 of the cup form.

The two breast cups 2 of a brassiere are substantial mirror image about the intermediate connection 5. Hereinafter reference will now be made to a single breast cup formed or to be formed from precursor materials however it will be appreciated that whilst reference is made to a single breast cup that such reference is also reflective of the provision of the same form of breast cup for the other cup to be incorporated into a brassiere.

With reference to FIG. 4 there is shown a breast cup 2. The breast cup is molded to a three dimensional form such as a cup form for the ultimate purpose of supporting and covering at least part of the breasts of the wearer. The breast cup 2 has been molded from materials which with reference to FIG. 1A, may include a first panel of flexible foam material 8, preferably a second panel of flexible foam material 9, a covering panel of flexible fabric material 10 and a second panel of covering flexible fabric material 11. In an alternative form however as for example shown in FIG. 8, the breast cup may be defined by a first panel of flexible foam material 8, the covering flexible fabric material 10 and the second panel of covering flexible material 11 without there being a provision of a second panel of flexible foam material 9.

Whilst in the most preferred form the panels herein described to define the assembly of panels extending across the thickness of a breast cup of the present invention. Whilst reference herein is made to such panels being directly affixed to each other preferably by laminating such as heat and/or adhesive laminating, it will be appreciated that panels or panel assemblies consisting of plies of sheet material may be provided intermediate of those panels herein defined as the essential or preferred form of the present invention.

To explain the construction details of the breast cup it is convenient to make reference to a preferred form of the method of forming the breast cup.

With reference to FIG. 1A there is shown a sectional view of the panels of the breast cup of the present invention consisting of a first panel of a flexible foam material 8 and a second panel of a flexible foam material 9. Disposed and preferably substantially coextensive with the first panel of foam material 8 there is provided a panel of flexible fabric material 10. The laminated form of the assembly of the panel 8 and 10 may be provided from roll stock material to be used in the method of the present invention. The foam panel 9 includes a first major surface 13 which is exposed and a second major surface 14 against which the fabric panel 10 is laminated. In this precursor form of the assembly of panel 8 and 10, such an assembly is in an unmolded condition and in a natural state assumes a flat or planar condition.

Figure 1B:
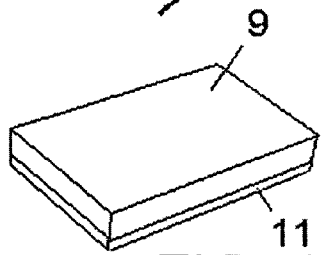
FIG. 1B is a perspective view of two precursor panels of the cup form of the present invention prior to being formed into a three dimensional shape and being cut to a perimeter of a cup form.
Figure 2:
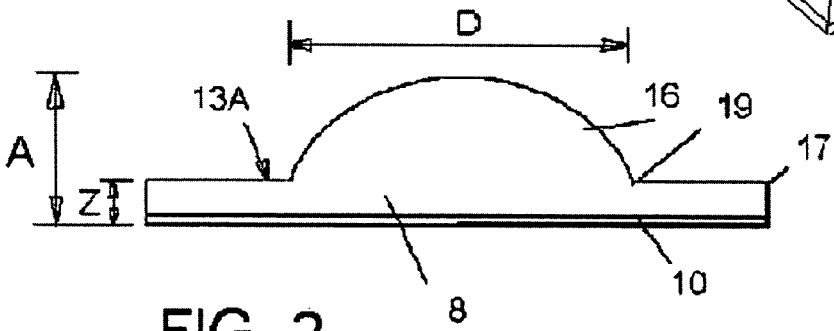
FIG. 2 is a sectional view through an assembly of panels for the purpose of manufacturing the cup of the present invention prior to being molded.

The second panel of flexible foam material 9 in assembly for example with the second panel of flexible fabric material 11 is also provided. The second panel of foam material 9 includes an exposed major surface 15 and a covered major surface 16 against which the second flexible fabric panel 11 is laminated. Like the assembly of panels 8 and 10, the panels 9 and 11 may be provided in a precursor form from a feed of roll stock and in a natural state assume a substantially planar or flat condition. With reference to FIG. 1B, there is shown an assembly of panels 9, 11 having been cut from a feed of roll stock into a substantially rectangular or square form. The size of the cut precursor panel assemblies is such that when subjected to molding in a molding machine to define the three dimensional cup form thereof, it is of a sufficiently large size to define the entire desired cup form. The first panel of foam material 8 is preferably of a greater thickness X than the thickness Y of the second panel of foam material 9. With reference to FIG. 2, the first panel of foam material 8 is formed to define a zone of increased thickness 16. This zone of increased thickness 16 is provided intermediate of the perimeter 17 of the assembly of panels 8, 10. The zone of increased thickness 16 is also provided inward (inward of the perimeter) of that region of the panel assembly 8, 10 into which a molded cup form to ultimately define a breast cup of the present invention will be defined.

Accordingly when formed to a cup form with the other panels to define the breast cup of the present invention as shown in FIG. 4, the zone of increased thickness 16 is provided inward from the perimeter 6 of the breast cup. In the preferred form the first panel of flexible foam material prior to being molded is formed to be of a substantially constant thickness Z save for the zone of increased thickness 16. In the most preferred form such contouring is by the shaving of the panel to define the contoured shape on the first major side 13 of the precursor panel of flexible foam material 8. After having been formed/shaped the then contoured first major surface 13A of the first panel of flexible foam material 8 will include the zone of increased thickness 16 extending from regions of reduced thickness at or towards the perimeter of the panel assembly 8, 10. The zone of increased thickness may for example be a dome shape as for example shown in FIG. 2 and of a constant diameter D. Alternatively the shape may be of a gradually undulation as for example shown in FIG. 5. So that the existence of this zone of increased thickness in the final version of the brassiere is to a large extent disguised, it is preferred that the zone of increased thickness 16 has a maximum thickness or summit substantially centrally within the zone and provides a reduction in thickness towards the perimeter 19 of the zone. Such reduction in thickness may be by a linear tapering as for example shown in FIG. 8 or may be a curve as for example shown in FIG. 5 out to the perimeter 17. In the most preferred form the second panel of flexible foam material 9 is not subjected to any contouring. The first panel of flexible foam material 8 is subjected to contouring but only on the non-fabric panel 10, disposed side of the first panel of flexible foam material 8.

The assembly of panels 8, 10 is then laminated with the assembly of panels 9, 11 in a molding device as for example shown in FIG. 3. The moulding molding device consists of two mold portions 20 and 21 each having formed therein a profile or contour of a kind to introduce into the precursor assemblies of panels the three dimensional or cup form of the breast cup. The upper mold portion 20 for example includes a concave relief and the lower portion 21 provides a convex upstand of a substantially complimentary shape to the concave recess of the upper mold portion 20. The assemblies of panels 8, 10 and 9, 11 are positioned intermediate of the mould mold portions in a manner so that they overly each other in an appropriate condition (preferably coextensively) whereupon the two mould mold portions are then brought together. The two mold portions are preferably heated. Additional adhesive may be placed intermediate of the assemblies 9, 11 and 8, 10 so that both pressure adhesive and heat will ensure that a good laminated bond can be established between the two subassemblies, the cup form can be trimmed from the molded precursor panels to define a perimeter shape such as for example shown in FIG. 4. Part of the perimeter of the cup form 6 may include an additional compression zone 23 where the overlying panels of material have been subjected to more enhanced compression than that of the main body portion 7. Such additional compression zones may serve the purpose of allowing for the cup to define a flange useful for the purposes of securing the cup to other components of the brassiere.

Figure 9:
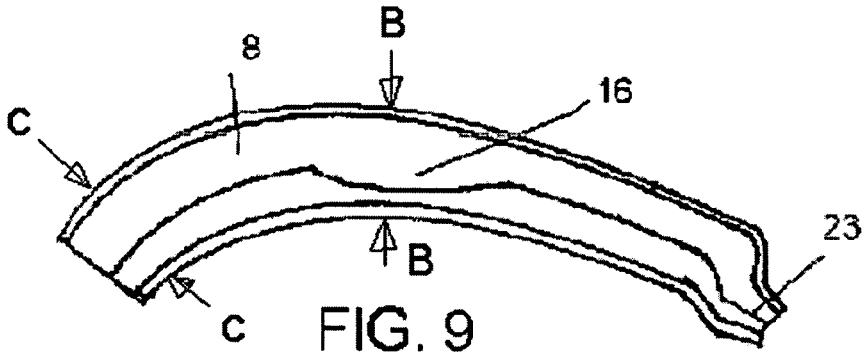
FIG. 9 is a sectional view through section 9—9 of FIG. 4 wherein the assembly of panels according to that shown in FIG. 3 is provided.

With reference to FIG. 4, it can be seen that upon the forming of a three dimensional form or cup form in the precursor materials as well as laminating the precursor materials together, will locate the zone of increased thickness 16 inward from the perimeter 6 of the breast cup 2. The zone of increased thickness 16 is provided within the body portion 7 of the breast cup 2. This zone of increased thickness is positioned to correspond with the usual location of the nipple of the breast of a wearer of a brassiere incorporating the breast cup 2. With reference to FIG. 9 there is shown a cross sectional view through section 9—9 of FIG. 4 wherein the zone of increased thickness 16 is shown to be provided to enhance the overall thickness of the breast cup in such zone. Thickness B is greater than thickness C. Whilst the thickness is perhaps only marginally greater at B than at C, a further enhancement to reduce the visibility of a nipple of a wearer through the breast cup is as a consequence of the higher density of material at the zone of increased thickness 16. Once the breast cup has been formed, the zone of increased thickness 16 will compress slightly such compression enhancing the material density at this zone thereby reducing the likelihood of observing the presence of the nipple through the breast cup. In the preferred form the thickness A is substantially the same as the thickness X and accordingly at the region of maximum thickness of the zone of increased thickness 16, little or no shaving or removal of the foam from the precursor precontoured panel of flexible foam material 8 has occurred.

Figure 8:
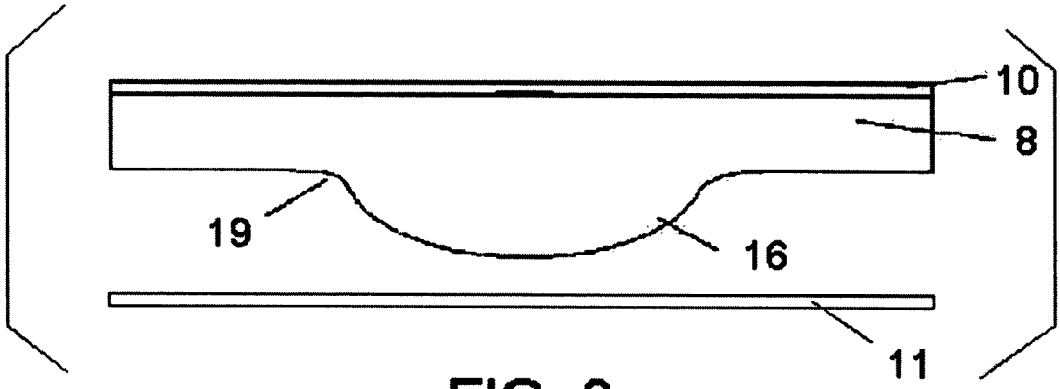
FIG. 8 is a sectional view through two precursor panels or panel assemblies prior to being laminated together and formed into a three dimensional cup form.

With reference to FIG. 6, there is shown an alternative to the formation of the zone of increased thickness 16 wherein a first ply of foam material 8A has engaged to its exposed major surface 13 a second ply of material 24 such as a like foam material which has been contoured to provide the same desired profile to the assembly of the first ply 8A and the second ply 24 as that shown for example in FIGS. 2, 5 or 8.

Figure 10:
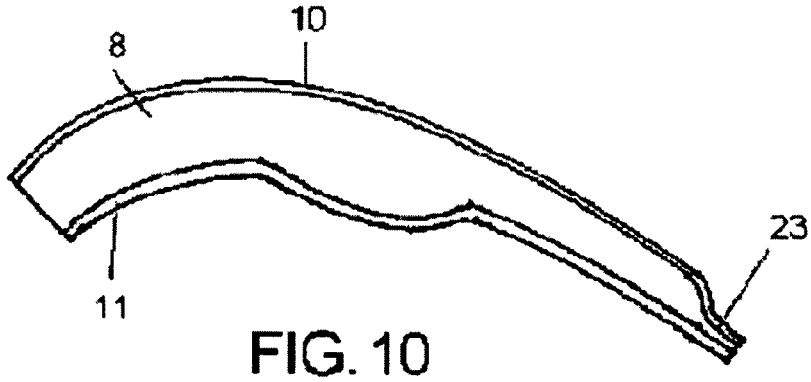
FIG. 10 is a sectional view through section 9—9 of FIG. 4 wherein an assembly of panels according to that shown in FIG. 8 is provided.

Whilst in the most preferred form the second assembly consisting of the second panel of flexible foam material 9 and panel of fabric material 11 is laminated by adhesion to the first panel of foam material 8, with reference to FIG. 8, there is shown an alternative. In FIG. 8 there is shown a first panel of flexible foam material 8 with which a flexible panel of fabric material 11 is to directly engage without the presence of a second panel of foam material 9 being present. An assembly of such a configuration formed to a cup form is for example shown in FIG. 10.

The invention claimed is:

1. A molded and gel-free breast cup for a brassiere, the breast cup comprising:

a molded cup-shaped and laminated structure of a first panel of a flexible foam material and a second panel of flexible material, said first and second panels being substantially coextensive to each other and define a breast cup perimeter shape, said first panel of flexible foam material being of varying thickness, both before and after being molded, for providing a zone of greater thickness at a region away from said perimeter more than regions of lesser thickness more proximate to said perimeter, said zone of greater thickness being located where, in use, a nipple of a wearer of said brassiere incorporating said breast cup is located, so that the nipple remains unnoticeable.

2. A molded breast cup as claimed in claim 1 wherein said second panel is a flexible foam material.

3. A molded breast cup as claimed in claim 1 wherein said second panel is a flexible fabric material.

4. A molded breast cup as claimed in claim 1 wherein said zone of greater thickness has a greater density than elsewhere in the breast cup.

5. A molded breast cup as claimed in claim 1 wherein said fist panel is of a uniform thickness save for at said zone of greater thickness.

6. A molded breast cup as claimed in claim 1 wherein said first panel, both before and after molding, is of a uniform thickness save for at said zone of greater thickness, the zone of greater thickness having a maximum thickness at the center of said zone and being of a gradually reducing thickness towards the perimeter of the zone.

7. A molded breast cup as claimed in claim 5 wherein the transition of thickness between said zone of greater thickness and said uniform thickness region of said first panel of flexible foam material is without sudden thickness change.

8. A molded breast cup as claimed in claim 5 wherein the transition of thickness between said zone of greater thickness and said uniform thickness region of said first panel of flexible foam material is with of a smooth transition.

9. A molded breast cup as claimed in claim 1 wherein said first panel has said varying thickness introduced by a contouring of a first major side thereof, the second major side thereof being uncontoured other than having been formed to said cup shape.

10. A molded breast cup as claimed in claim 9 wherein said first major side of said first panel is disposed to the second panel.

11. A molded breast cup as claimed in claim 9 wherein said first major side of said first panel is engaged to the second panel.

12. A molded breast cup as claimed in claim 1 wherein said first panel is engaged to the second panel.

13. A molded breast cup as claimed in claim 1 wherein said first panel is a unitary panel.

14. A molded breast cup as claimed in claim 1 wherein said first panel consists of a first ply of foam material of a uniform thickness and a second ply of material engaged therewith in a manner to create said zone of greater thickness.

15. A molded breast cup as claimed in claim 14 wherein said second ply is of a foam material.

16. A molded breast cup as claimed in claim 1 wherein first panel of fabric material overlies said assembly to the concave said of its said cup shape.

17. A molded breast cup as claimed in claim 16 wherein first panel of fabric material is laminated to one of said first panel of flexible foam material and second panel.

18. A molded breast cup as claimed in claim 1 wherein a second panel of fabric material overlies said assembly to the convex said of said cup shape.

19. A molded breast cup as claimed in claim 18 wherein a second panel of fabric material is laminated to the other of said first flexible foam material and said second panel.

20. A molded breast cup as claimed in claim 1 wherein said first panel is disposed to the concave side of said cup shape and said second panel is disposed to the convex side of said cup shape.

21. A molded breast cup as claimed in claim 1 wherein said first panel is disposed to the convex side of said cup shape and said second panel is disposed to the concave side of said cup shape.

22. A molded breast cup as claimed in claim 1 wherein said first panel is disposed to the concave side of said cup shape and said second panel is disposed to the convex side of said cup shape.

23. A molded breast cup as claimed in claim 1 wherein said first and second panels contain no seams, lines of stitching, inward of a region immediately adjacent said perimeter.

24. A molded breast cup as claimed in claim 1 containing no seams, lines of stitching, inward of a region immediately adjacent said perimeter.

25. A gel-free brassiere incorporating a breast cup as claimed in claim 1.

* * * * *